United States Patent [19]

Williams

[11] Patent Number: 4,724,803

[45] Date of Patent: Feb. 16, 1988

[54] ROLLING CONTACT ROCKER ARM WITH REACTION MEMBER, ROCKER KEY AND ROLLER FOLLOWER

[75] Inventor: Donald L. Williams, Port Clinton, Ohio

[73] Assignee: General Motors Corporation, Detroit, Mich.

[21] Appl. No.: 919,431

[22] Filed: Oct. 16, 1986

Related U.S. Application Data

[63] Continuation-in-part of Ser. No. 867,998, May 29, 1986, abandoned.

[51] Int. Cl.[4] ..... F01L 1/18

[52] U.S. Cl. ..... 123/90.39; 123/90.47; 123/90.41

[58] Field of Search ..... 123/90.39, 90.41, 90.42, 123/90.43, 90.45, 90.47, 90.48

[56] References Cited

U.S. PATENT DOCUMENTS

| | | | |
|---|---|---|---|
| 814,421 | 3/1906 | Austin | 123/90.16 |
| 1,497,451 | 6/1924 | Kytlica | 123/90.41 |
| 1,573,075 | 2/1926 | Lehmann | 123/90.47 |
| 1,644,750 | 10/1927 | Short | 123/90.47 |
| 2,943,612 | 7/1960 | Middler | 123/90.41 |
| 4,393,820 | 7/1983 | Maki et al. | 123/90.41 |
| 4,543,920 | 10/1985 | Bonvallet | 123/90.43 |

*Primary Examiner*—Craig R. Feinberg
*Assistant Examiner*—M. Macy
*Attorney, Agent, or Firm*—Arthur N. Krein

[57] ABSTRACT

A rocker arm in an internal combustion engine is pivotably supported by a fixed fulcrum retainer with a rocker key operatively positioned therebetween. The rocker arm and fulcrum retainer each have a concave, semi-cylindrical bearing surface and the rocker key has a pair of spaced apart, opposed convex, semi-cylindrical bearing surfaces, the concave, semi-cylindrical bearing surfaces and associate convex, semi-cylindrical bearing surfaces having radii ratios on the order of 1.7:1 to 3:1 and preferably 2:1 whereby to effect substantial rolling contact of these elements relative to each other. In addition, the rocker arm is preferably of U-shaped configuration as defined by a base with side walls depending from opposite sides thereof. A roller follower is operatively and rotatably positioned between the side walls at one end of the rocker arm, with the roller follower having an outer peripheral surface of a diameter whereby the outer peripheral surface is in rolling contact with the base and an associate element of the valve train at this end of the rocker arm. A roller support shaft is operatively associated with the side walls and with the roller follower to loosely retain the roller follower in unit assembly with the rocker arm.

10 Claims, 9 Drawing Figures

ROLLING CONTACT ROCKER ARM WITH REACTION MEMBER, ROCKER KEY AND ROLLER FOLLOWER

This application is a continuation-in-part application of copending U.S. patent application Ser. No. 867,998 filed May 29, 1986, now abandoned in the name of Donald L. Williams and assigned to a common assignee.

FIELD OF THE INVENTION

This invention relates to valve trains for internal combustion engines and, in particular, to a rolling contact rocker arm with fixed reaction member and rocker key assembly and, with a roller follower on the rocker arm for use in such valve trains.

DESCRIPTION OF THE PRIOR ART

Conventional rocker arm and pivot assemblies, as normally used in passenger vehicle type engine valve trains, for example, as used in an overhead valve push-rod type actuated valve train, include a pedestal mounted rocker arm which generally has a spherical or part cylindrical pivot or fulcrum that provide essentially large bearing surfaces. With such an arrangement, the rocker arm is actually in sliding engagement relative to its associate fulcrum and, thus even though these elements may be adequately lubricated, this type of arrangement still provides a large area for frictional resistance.

The desirability to overcome the above problem has been recognized and, accordingly, it has been proposed to provide a rocker arm and pivot arrangement such that the rocker arm is claimed to be movable about a support in rolling motion in a manner shown, for example, in U.S. Pat. No. 2,943,612 entitled "Valve Gear", which issued on July 5, 1960 to Alexander G. Middler, as an improvement over the rocker arm pivot structure shown in U.S. Pat. No. 1,497,451 entitled "Rocker Arm" issued June 10, 1924 to John F. Kytlica. However, it will be apparent that the rolling contact between the rocker arm and pivot of this U.S. Pat. No. 2,943,612 teaching is comparable to that of a cylinder rolling on a flat or substantially flat surface.

As further improvements, there has been disclosed in U.S. Pat. No. 4,393,820, issued July 19, 1983 to Emil R. Maki; Ferdinand Freudenstein; Raymond L. Richard, Jr., and Meng-Sang Chew, and in U.S. Pat. No. 4,543,920 entitled "Hypocyclic Rolling Contact Rocker Arm and Hydraulic Lash Adjuster Pivot", issued Oct. 1, 1985 to Duane J. Bonvallet, differing arrangements of a rolling contact rocker arm and pivot assemblies each of which includes a rocker arm with a semi-cylindrical bearing surface intermediate its ends and an associate fixed pivot member having a semi-cylindrical fulcrum bearing surface, the ratio of the radii of these surfaces being on the order of 2:1 to provide for cardanic motion. In these assemblies, one of the bearing surfaces is provided with a guide recess or slot therein of a size and shape so as to receive in substantially rolling contact a raised retainer pin provided on the other bearing surface, the slot and retainer being located intermediate the arcuate ends of the respective bearing surfaces.

SUMMARY OF THE INVENTION

A primary object of the present invention is to provide an improved rocker arm and fixed pivot assembly wherein an inverted U-shaped-type rocker arm and its fixed fulcrum retainer are provided with part circular concave bearing surfaces with a rocker key having opposed convex bearing surfaces operatively positioned therebetween, with these concave and convex bearing surfaces, respectively, having a radius relationship of substantially 2 R and R, respectively, the rocker arm and fulcrum retainer being provided, in effect, with opposed fore and aft retainer portions whereby there is effected substantially rolling or walking contact between all parts relative to each other during pivotable movement of the rocker arm.

Accordingly, another object of this invention is to provide an improved rocker arm and fulcrum retainer assembly wherein the fulcrum retainer and the rocker arm each define a pair of cooperative outer semi-cylindrical bearing surface contours with a rocker key having opposed inner semi-cylindrical bearing surface contours carrying the reaction forces of the rocker arm pivotal movement, the radius of the outer conformations being substantially two times the radius of the inner conformations, the rocker arm at least at one end thereof preferably being of inverted U-shaped configuration as defined by a base wall with side walls depending from opposite sides thereof and having a roller follower operatively and rotatably positioned between the side walls, the roller follower preferably having an outer peripheral surface of an external diameter whereby its outer peripheral surface is in rolling contact with the base wall and an associate element, such as a cam or lash adjuster and, a roller support shaft operatively associated with the side walls and the roller follower to operatively retain the roller follower on the rocker arm.

Still another object of this invention is to provide an improved rocker arm and fulcrum retainer with a rocker key assembly for use in the valve trains of internal combustion engines which, in operation, is characterized by minimum energy loss to thus maximize fuel efficiency.

A still further object of the present invention is to provide a rocker arm and a fulcrum retainer with rocker key of the above type which is easy and inexpensive to manufacture, which is reliable in operation, and in other respects suitable for use on production motor vehicle engines.

For a better understanding of the invention, as well as other objects and further features thereof, reference is had to the following detailed description to be read in connection with the accompanying drawings.

Figure 1:
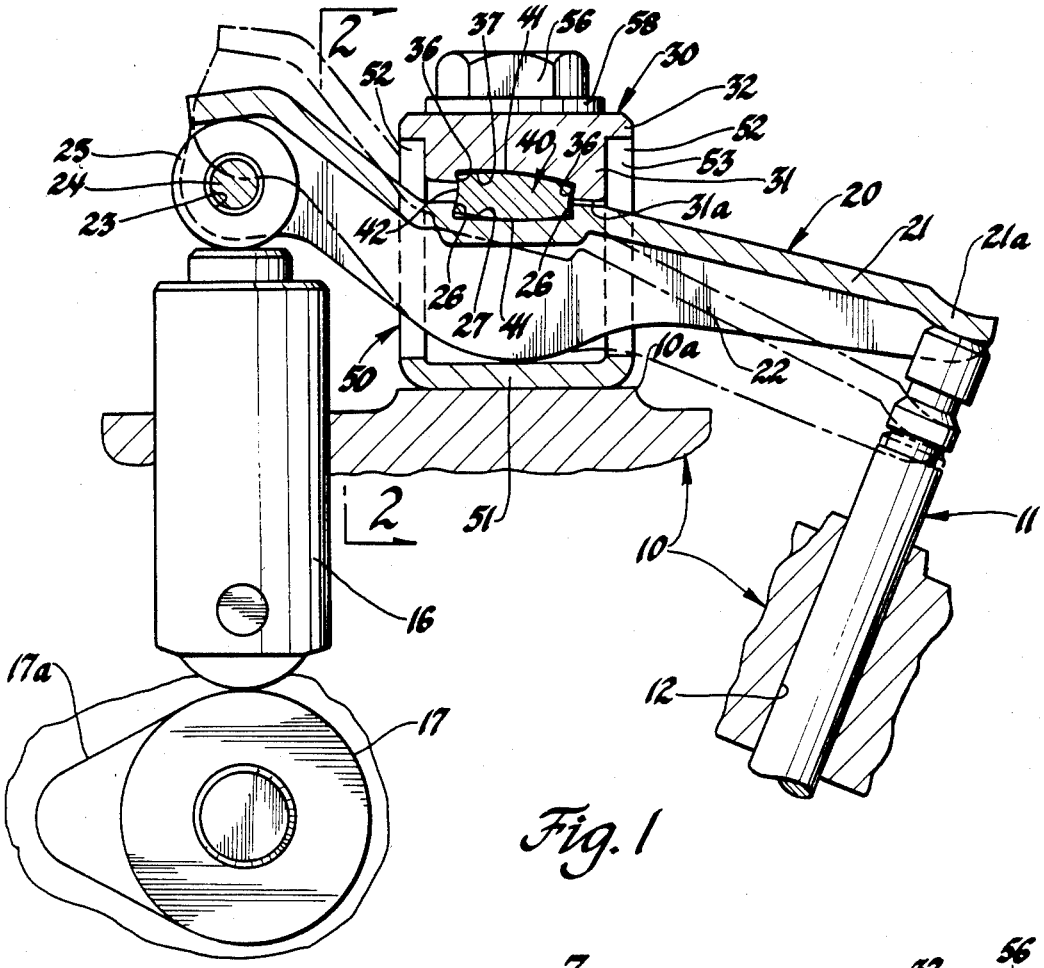
FIG. 1 is a cross-sectional view of a portion of an internal combustion engine having a valve train in accordance with the invention incorporated therein, the rocker arm being shown in the valve closed position.
Figure 2:
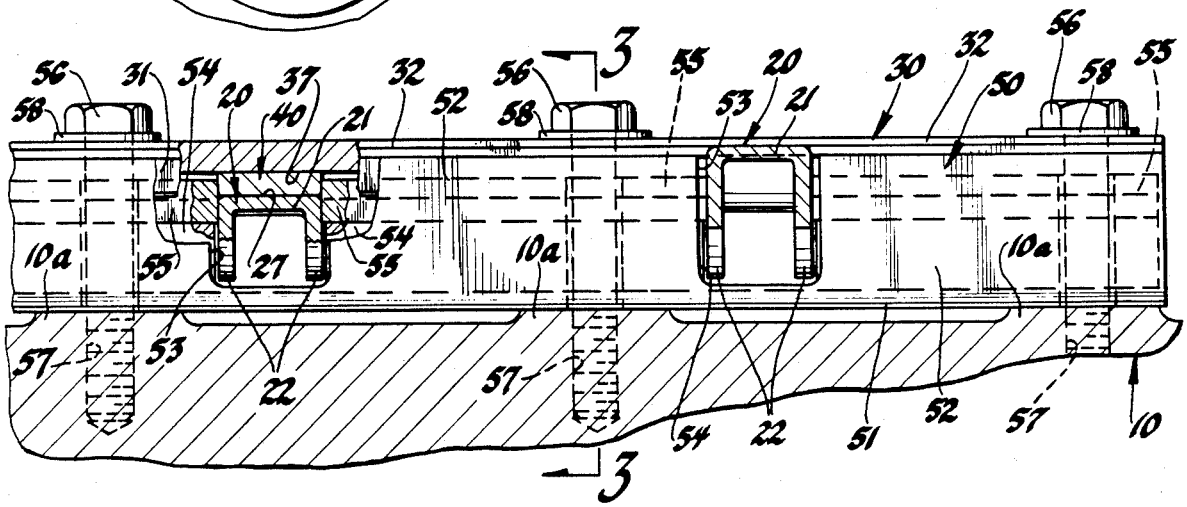
FIG. 2 is a side view taken along line 2—2 of FIG. 1 showing an upper portion of the valve train including plural rocker arms and fulcrum retainer, rocker key and spacer bars, per se, of the valve train of FIG. 1.
Figure 3:
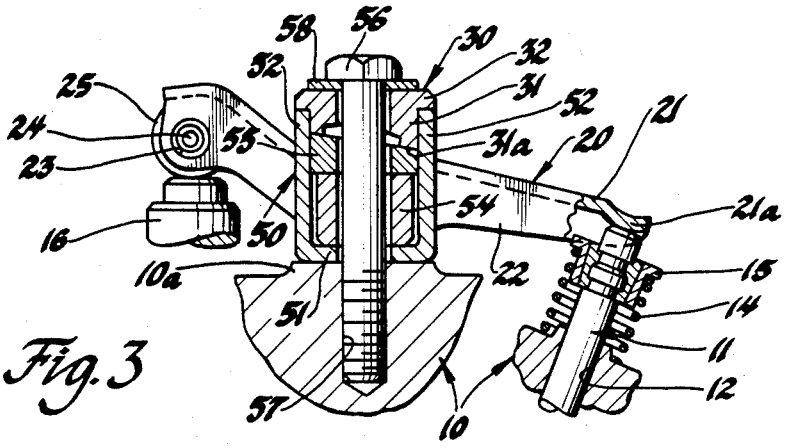
FIG. 3 is a cross-sectional view, taken along line 3—3 of FIG. 2, showing the rocker arm and fulcrum retainer and a spacer bar of the valve train assembly.

Referring first to FIGS. 1, 2 and 3, there is shown a portion of a multi-cylinder internal combustion engine having a cylinder head 10, as part of an engine block means, in which a poppet valve 11 (intake or exhaust) is operatively mounted to control the ingress of a combustion mixture to an associate cylinder, not shown in detail, of the engine or to control the egress of exhaust from the associate cylinder, with a valve train, in accordance with the invention, operatively associated with the valve 11 to effect its operation.

As best seen in FIG. 1, each poppet valve 11 is guided for axial reciprocation in a valve stem guide bore 12 provided for this purpose in the cylinder head 10, with the upper portion of the poppet valve 11 projecting above the cylinder head. In a conventional manner, each poppet valve 11 would normally be maintained in a closed position by a spring 14 encircling the upper portion of the stem of the valve 11, with one end of the spring 14 abutting against the cylinder head 10 and the other end operatively engaging a conventional retainer washer assembly 15 secured to the stem of the poppet valve 11 in a conventional manner, see FIG. 3, since the spring and retainer washer assembly are both not shown in FIG. 1 so as to permit showing of the rocker arm therein in both a valve closed and valve open position.

A conventional roller type, hydraulic valve lifter or tappet 16 which is reciprocably disposed in the cylinder head laterally of the poppet valve 11, has its upper end projecting above the cylinder head 10, and has its lower end operatively engaging the cam 17*a* of a camshaft 17 in a conventional manner whereby during engine operation the hydrualic valve tappet 16 is caused to reciprocate, as determined by the profile of the cam on the camshaft to effect pivotal movement of an associate rocker arm, generally designated 20, to be described in detail hereinafter.

Thus the motion of a hydraulic valve tappet 16 is imparted to an associate poppet valve 11 by means of an associate rocker arm 20.

Now in accordance with one of the features of the invention, each of the rocker arms 20 for an in-line row of poppet valves 11 may be pivotably supported by a fixed reaction member or fulcrum retainer 30 and by means of an associate rocker key 40 in a manner to be described.

As best seen in FIGS. 1 and 3, the fulcrum retainer 30, which is of a T-shaped configuration, is of a longitudinal extent whereby to pivotably support a plurality of rocker arms 20, two such rocker arms 20 being shown in FIG. 2, and this fulcrum retainer 30 is supported above the cylinder head 10 a predetermined extent by means of a U-shaped support channel 50 having the base 51 thereof positioned in abutment against machined pads 10*a* on the upper surface of the cylinder head 10. As best seen in FIGS. 1 and 3, the fulcrum retainer 30 has a base portion 31 of a suitable width so as to be slidably received between the upright legs 52 of the support channel 50 and a cross member portion 32 of a suitable width so that the lower surface thereof is supported by the free end surface of the upright legs 52.

As best seen in FIG. 2, the upright legs 52 of the support channel 50 are provided with spaced apart U-shaped slots 53 of a suitable width so as to loosely receive an associate rocker arm 20. In addition and as best seen in FIGS. 2 and 3, a lower spacer 54 and a prism spacer 55 are sandwiched between the base 51 of the support channel 50 and the lower inclined free surface end 31*a* of the base portion 31 of the fulcrum retainer 30 between each outboard end, the right hand end with reference to FIG. 2, and also between adjacent pairs of rocker arms 20. In addition, the fulcrum retainer 30, the base 51 of the support channel 50 are provided with spaced apart apertures and each set of a lower spacer 54 and prism spacer is provided with an associate aligned aperture therethrough so as to receive a machine screw 56 that is threadingly received in an associate threaded aperture 57 provided for this purpose in the cylinder head 10. As shown, a load bearing washer 58 is positioned beneath the head of a machine screw 56 so as to abut against the fulcrum retainer 30. Thus at each machine screw 56 position the following elements, i.e., the fulcrum retainer 30, the prism spacer 55, a lower spacer 54 and the base 51 of the support channel 50, cooperate to provide a solid stack-up of these elements to support the clamping load of each machine screw 56. Also as shown, each prism spacer 55 is so configured that adjacent sets thereof will have end faces which will act as stops to limit the side-ways movement with respect to FIG. 2, of an associate rocker key 40 to be described in detail hereinafter.

Referring now to the rocker arms 20, each such rocker arm is preferably formed as a sheet metal stamping of inverted U-shaped configuration with a base wall 21 and depending spaced apart side walls 22. As best seen in FIGS. 1 and 2, the side walls 22 at the actuated end of a rocker arm 20 are provided with apertures 23 so as to receive a pin 24 that operatively supports a conventional roller follower 25 in a position so that this roller follower 25 engages the upper end of a hydraulic valve tappet 16. At the opposite end of the rocker arm 20, the base wall 21 is provided with an arcuate portion 21*a* that abuts against the free stem end of an associate poppet valve 11 so as to be in substantial rolling contact therewith during pivotable movement of the rocker arm 20.

Figure 4:
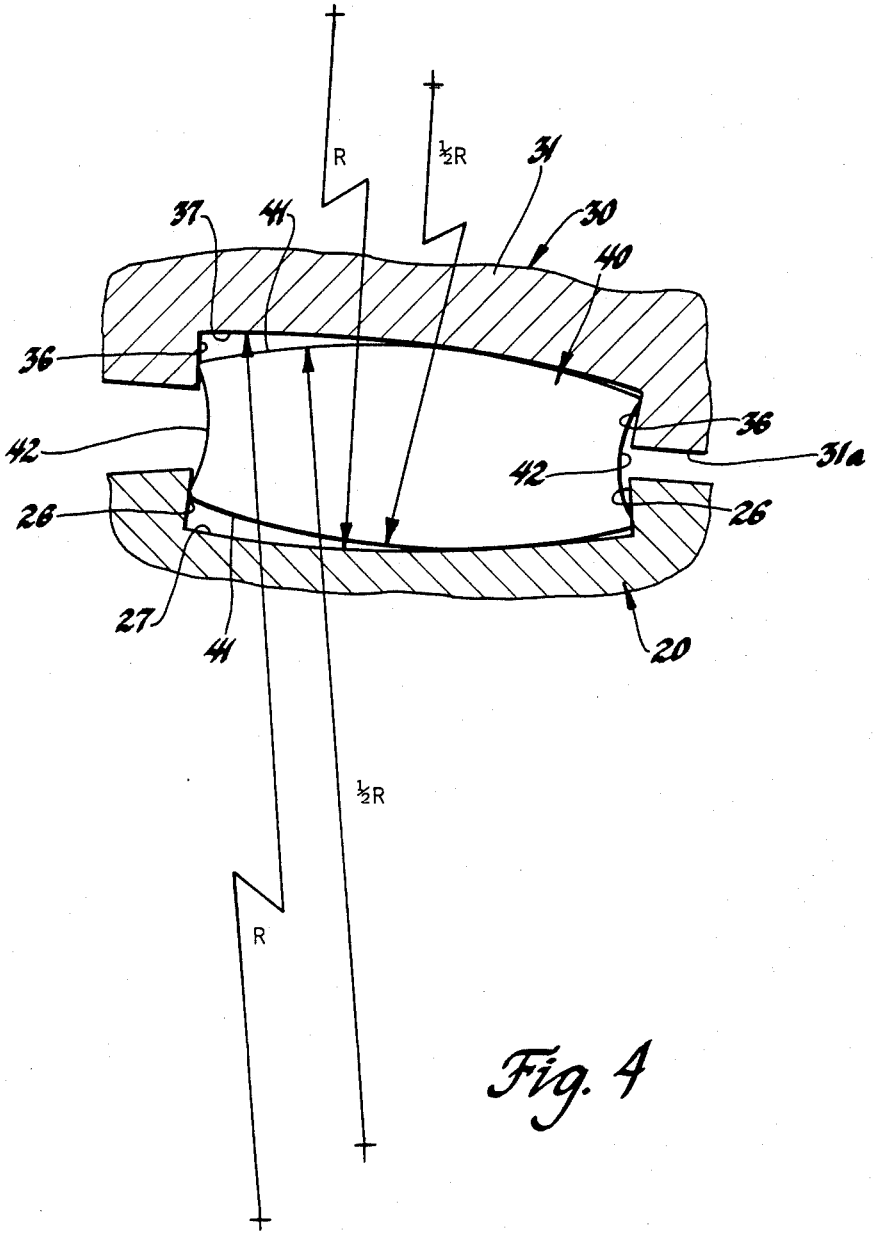
FIG. 4 is an enlarged cross-sectional view, showing the rocker arm, rocker key and fulcrum retainer, per se, the rocker key being shown in elevation.

At a predetermined location intermediate its ends, the base wall 21 of the rocker arm 20 is deformed to provide a recess for a portion of an associate rocker key 40, the recess being defined, as best seen in FIGS. 1 and 4, by spaced apart inwardly inclined side walls 26 and a concave, semi-cylindrical bearing surface 27 base.

The lower inclined surface 31*a* of the base portion 31 of the fulcrum retainer 30 is provided with a similar shaped recess, preferably for its longitudinal extent, this recess being defined by spaced apart inwardly inclined side walls 36 and a concave, semi-cylindrical bearing surface 37 base.

Each rocker arm 20 can thus be pivotably supported by the fulcrum retainer 30 by means of an associate rocker key 40.

As best seen in FIGS. 1 and 4, each rocker key 40 is provided with spaced apart, convex, semi-cylindrical bearing surfaces 41 and rolled over concave end surface 42, the arrangement being such that an upper portion of the rocker key 40, with reference to the FIGS. 1 and 4 is received in the recess of the fulcrum retainer 30 while its lower portion is received in the recess of an associate rocker arm 20. Also, as best seen in FIG. 1, the thickness of a rocker key 40 is such that during pivotable movement of a rocker arm 20 between a valve closed and a valve open position, as seen in FIG. 1, it will be retained within the recess of the fulcrum retainer 30 and the recess in an associate rocker arm 20 and prevent the rocker arm 20 from contacting the fulcrum retainer 30. Also as shown in FIG. 2, each rocker key 40 is prevented from slipping or sliding out of engagement of the recess in an associate rocker arm 20 by means of the spaced apart associate pair of prism spacers 55 which have their opposed free ends spaced apart so as to allow for free pivotal movement of both a rocker arm 20 and its associate rocker key 40.

Now in accordance with a feature of the invention, the bearing surface 27 of a rocker arm 20 and the bearing surface 37 of the fulcrum retainer 30 are formed with preferably a suitable predetermined radius R, while the bearing surfaces 41 of the rocker key 40 are formed with substantially a radius ½R, so that during pivotable movement of a rocker arm 20, the bearing surfaces 41 of the associate rocker key 40 will be in substantial rolling contact with the bearing surfaces 27 and 37 of the associate rocker arm 20 and fulcrum retainer 30, respectively. The relative rolling contact between these bearing surfaces contours having a radii ratio of 2:1 may be referred to as cardanic motion as more fully described in the above-identified U.S. Pat. No. 4,393,820.

During such pivotal movement of the rocker arm 20 as normally encountered in automotive engines, there will be some tendency for the rocker key 40 to step or "squirt" from between the recess surfaces in the rocker arm 20 and fulcrum retainer 30 as the rocker arm 20 approaches either end of its pivotal travel. The "squirting" is of course restrained by the opposed side walls 26 of the rocker arm 20 and by the opposed side walls 36 of the fulcrum retainer 30 which engender some slight energy loss due to the frictional sliding of the rounded concave end surfaces 42 of the rocker key 40. This energy loss is deemed to be relatively slight since the "squirting" forces themselves are of low magnitude. These side walls 26 and 36 thus will act to key the assembly together and enforce essentially pure rolling contact throughout the entire pivotal movement of a rocker arm 20.

The rolling contact between a rocker arm 20 and its associate rocker key 40 and between this rocker key 40 and the fulcrum retainer 30 is comparable to that of a cylinder rolling in a conforming cylinder.

Although cardanic motion is obtained by having the radii of the bearing surfaces 27, 37 and 41 formed in the ratio R:½R or 2:1, which is the preferred configuration, it will be apparent to those skilled in the art that this ratio may be varied, if desired within predetermined limits. Thus, for example, if the rocker arm need only move through a relatively small angular displacement to effect the desired valve opening movement in a particular engine application, it may then be possible to obtain substantial rolling contact performance which closely approximates cardanic motion with circle radii ratios other than 2:1. For example, the ratio of these cooperating radii could be reduced down to 1.7:1 or increased above 2:1 to, for example, the ratio of 3:1 with favorable results.

However, it should be realized that as the ratio of these radii varies from the ratio of 2:1 the stress load on the rocker arm 20 will be increased accordingly. It should therefore be apparent to those skilled in the art that as long as the angular displacement of the rocker arm 20 is acceptably small, the minor deviation from cardanic rolling motion may be acceptable in a given engine application.

It should also be realized, that although the rocker key 40 is shown as being of symmetrical configuration, this rocker key can be asymmetric and thus for example the bearing surface 37 of the fulcrum retainer 30 may have a radius R while the associate bearing surface 41 of the rocker key may have a radius ½ R and, the bearing surface 27 of the rocker arm 20 can have a radius R′ so that the associate bearing surface 41 of the rocker key 40 will then have a radius of ½ R′.

In view of the essentially rolling contact of the rocker key 40 relative to an associate rocker arm 20 and to the fulcrum retainer 30, the lubricating requirements of these valve train elements can be adequately provided as, for example, by simple conventional splash or mist methods, not shown. It will also now be appreciated by those skilled in the art, that a lubricating oil conduit with individual jet discharge passages to each rocker key 40 area can be provided in the fulcrum retainer 30 in the same manner as is conventional in fixed rocker shafts.

Preferred alternate embodiments in accordance with another feature of the invention are shown in FIGS. 5 through 9, inclusive, wherein similar parts are designated by similar numerals but with the addition of a prime, double prime or triple prime where appropriate.

Figure 5:
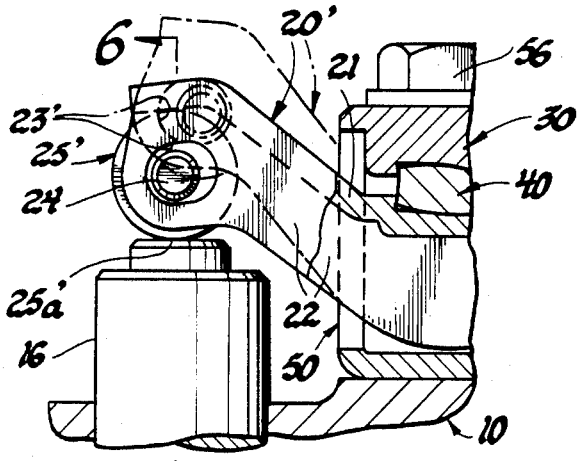
FIG. 5 is a view of the actuated end of the rocker arm with associated lash adjuster and drive cam and having a roller follower in accordance with a preferred embodiment of the invention incorporated with the rocker arm.
Figure 6:
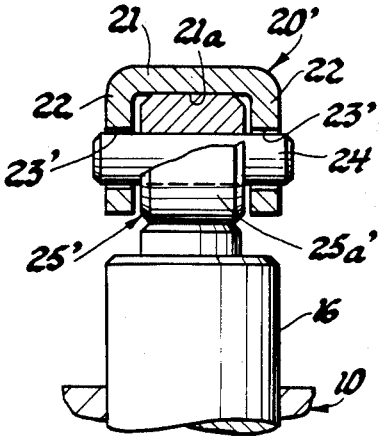
FIG. 6 is a cross-sectional view of the rocker arm and roller follower of FIG. 5 taken along lines 6—6 of FIG. 5.

Referring now to FIGS. 5 and 6, in a first preferred embodiment, the actuated end of the rocker arm 20′ is, as previously described, of inverted U-shaped configuration as defined by a base wall 21 with integral depending side walls or sides 22 at opposite sides thereof. In this embodiment, the sides 22 are each provided with an elongated aperture 23′ of a size so as to slidably receive a pin 24 fixed to and extending through the roller follower 25′.

Accordingly, as another feature of the invention, the roller follower 25′ is of a predetermined external diameter such that the outer peripheral surface 25*a*′ thereof will be in rolling contact on one side thereof with the valve actuator, which in the construction illustrated is the hydraulic valve tappet 16, while the other side of the outer peripheral surface 25*a*′ is in rolling contact with the bottom surface 21*a* of the base 21 of the rocker arm 20′.

With this arrangement of the roller follower 25′, as best seen in FIG. 5, as the rocker arm 20′ is pivoted from the position shown in solid lines to the position shown by broken lines, it will be apparent that the roller follower 25′ and its pin 24 will have moved to the right, with reference to this Figure, due to the rolling contact of the peripheral surface 25*a*′ of the roller follower against the upper surface of the valve actuator, i.e., the hydraulic valve tappet 16 and the bottom surface 21*a* of the base 21 of the rocker arm 20′. Thus any sliding friction, as between the hydraulic valve tappet 16 and the roller follower 25′ is eliminated.

Figure 7:
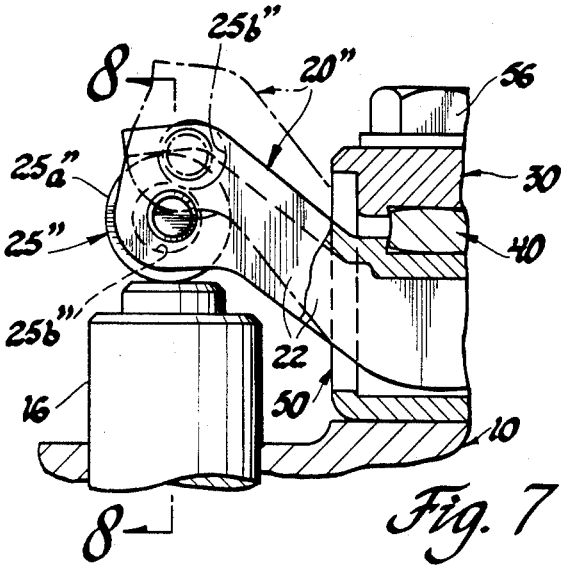
FIG. 7 is a view similar to FIG. 5 but showing a second preferred embodiment roller follower associated with the rocker arm.
Figure 8:
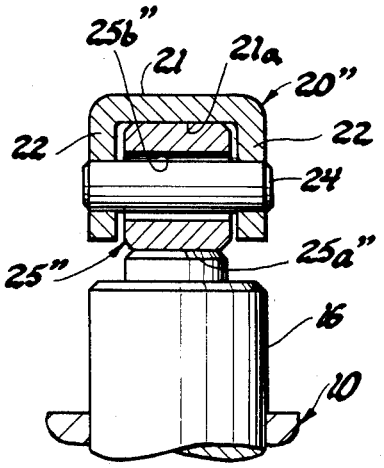
FIG. 8 is a cross-sectional view of the rocker arm and roller follower of FIG. 7 taken along line 8—8 of FIG. 7; and, FIG. 9 is a view similar to that of FIG. 8 but showing a further alternate embodiment of the roller follower.
Figure 9:
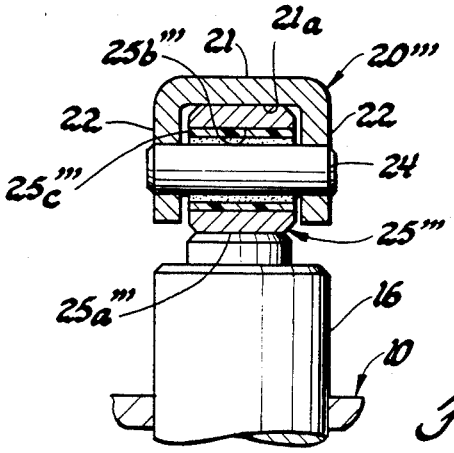

It should be noted that in the first preferred embodiment shown in FIGS. 5 and 6 and also in the embodiments shown in FIGS. 7, 8 and in FIG. 9, the load is entirely supported by the compressive stiffness of the roller follower 25' itself with no reaction forces at the "axle", that is, at the pin 24. Thus in this embodiment the pin 24 is not really functioning as an axle at all, but merely defines a pair of concentric cylindrical projections, which may be formed by a pin of suitable length press-fitted into the roller follower 25'. The projections of the pin 24, in cooperation with the elongated slots or apertures 23' provided in the sides 22 of the rocker arm 20', capture the roller follower 25' and limit its excursion during an angular sweep of the rocker arm 20'. Thus as illustrated, the width of the elongated apertures 23' can be such that the opposite ends of the pin 24 never need to touch the sides of the elongated apertures 23' so that, ideally, no sliding friction need exist. The sides 22 of the rocker arm 20' serve to guide the roller follower 25' and to prevent any substantial sidewise movement of the roller follower 25'.

In an alternate preferred embodiment shown in FIGS. 7 and 8, wherein the axle or pin 24 is press fitted or otherwise fixed in the sides 22 of the rocker arm 20" and the roller follower 25" also of a suitable external diameter as roller follower 25', has an enlarged bore 25*b*" of such an internal diameter so that the diametral clearance between the inner peripheral surface defined by the bore 25*b*" and the pin 24 will freely allow the full kinematic rolling contact movement of the outer peripheral surface 25*a*" of the roller follower 25" against the upper surface of the hydraulic valve tappet 16 and the bottom surface 21*a* as the rocker arm 20" undergoes a complete cycle of oscillation.

A still further embodiment of the arrangement shown in FIGS. 7 and 8 is shown in FIG. 9 wherein a bushing 25*c*''' of either polymeric or elastic materials is inserted into the bore 25*b*''' in the roller follower 25''' to cushion or absorb any impact noise that might be generated under certain dynamic operating conditions of the valve train.

As previously described with reference to the embodiment shown in FIGS. 5 and 6, the roller followers 25" and 25''' of the embodiment shown in FIGS. 7 and 8 and in FIG. 9, respectively, the actuating load is supported by the compressive stiffness of each of these roller followers 25" and 25''', with no reaction forces at the respective axle or pins 24. Each of the pins 24 is merely used to capture its associate roller follower 25" or 25''' to the associate rocker arm 20" or 20''', respectively, and to limit its excursion during pivotable movement of its associate rocker arm.

While the invention has been described with reference to the structure disclosed herein, it is not confined to the specific details set forth, since it is apparent that many modifications and changes can be made by those skilled in the art. For example, while the roller follower, with reference to the preferred embodiments, is shown and described as being operatively associated with the actuated end of a rocker arm, it will be appreciated that in certain rocker arm applications, it could be associated with the valve engaging end of the rocker arm and, also, such roller follower arrangement could be used with other forms of rocker arms. This application is therefore intended to cover such modifications or changes as may come within the purposes of the improvements or scope of the following claims.

The embodiments of the invention in which an exclusive property or privilege is claimed are defined as follows:

1. A reciprocating internal combustion engine of the type having an engine block defining a cylinder with a port, a valve reciprocably located in said port and biased to a predetermined position, a valve actuator spaced from the valve and movable in opposite sense to reciprocate said valve, and a valve train means including a rocker arm in engagement with the valve and the valve actuator and actuated in rocking movement through a range of rocker arm oscillation to reciprocate said valve against said bias to open and close the port for engine operation, the improvement comprising: means defining a rocking support intermediate the length of said rocker arm, said means including a fixed reaction member and a rocker key, said rocker arm and said reaction member defining a pair of opposed, spaced apart recessed outer, concave, semi-cylindrical bearing surface contours of predetermined radii, and said rocker key located between and directly engaging said respective outer cylindrical bearing surface contours of said rocker arm and reaction member, respectively said rocker key defining a pair of opposed, spaced apart inner, convex, semi-cylindrical bearing surface contours each of a predetermined radius which cooperate with a respective one of said outer, concave semi-cylindrical bearing surfaces to carry the reaction forces of rocker arm pivotal movement, said outer semi-cylindrical bearing surface contours being in the range of about 1.7:1 to 3:1 times the radius of said inner semi-cylindrical bearing surface contours, whereby within said range of rocker arm oscillation said rocker key is in substantially rolling contact with the outer cylindrical bearing surface contours on said rocker arm and on said reaction member wherein said rocker key will rock as said rocker arm oscillates.

2. In a reciprocating internal combustion engine according to claim 1, the improvement wherein at least the valve actuator end of the rocker arm is of an inverted U-shaped configuration as defined by a base with side walls depending from opposite sides of said base wall, a roller follower operatively and rotatably positioned between said side walls, a pin means operatively associated with said side walls and said roller follower so as to capture said roller follower between said side walls, said roller follower having an external diameter such that the outer peripheral surface of said roller follower is in rolling contact with said base wall and the said valve actuator.

3. A reciprocating internal combustion engine of the type having an engine block defining a cylinder with a port, a valve reciprocably located in said port and biased to a predetermined position, a valve actuator spaced from the valve and movable in opposite sense to reciprocate said valve, and a valve train means including a rocker arm in engagement with the valve and the valve actuator and actuated in rocking movement through a range of rocker arm oscillation to reciprocate said valve against said bias to open and close the port for engine operation, the improvement comprising: means defining a rocking support intermediate the length of said rocker arm, said means including a fixed reaction member and a rocker key, said rocker arm and said reaction member each having a recess therein defining a pair of opposed, spaced apart side walls and an outer, concave, semi-cylindrical bearing surface contour each of a predetermined radius, and said rocker key located between and directly engaging said respective outer cylindrical bearing surface contours of said rocker arm and reaction member, respectively said rocker key defining a pair of opposed, spaced apart inner, convex, semi-cylindrical bearing surface contours of predetermined radii which a respective one of cooperate with said outer, concave, semi-cylindrical bearing surfaces to carry the reaction forces of rocker arm pivotal movement, said outer, concave, semi-cylindrical bearing surface contours being about 2 times the radius of said inner cylindrical bearing surface contours, whereby within the range of rocker arm oscillation said rocker key is in substantially rolling contact with said outer, concave, semi-cylindrical bearing surface contours on said rocker arm and on said reaction member wherein said rocker key will rock as said rocker arm oscillates.

4. A reciprocating internal combustion engine of the type having an engine block defining a cylinder with a port, a valve reciprocably located in said port and biased to a predetermined position, a valve actuator spaced from the valve and movable in opposite sense to reciprocate said valve, and a valve train means including a rocker arm in engagement with the valve and the valve actuator and actuated in rocking movement through a range of rocker arm oscillation to reciprocate said valve against said bias to open and close the port for engine operation, the improvement comprising: means defining a rocking support intermediate the length of said rocker arm, said means including a fixed reaction member, a rocker key and fixed spaced apart spacer means, said rocker arm and said reaction member defining a pair of opposed, spaced apart recessed outer, concave, semi-cylindrical bearing surface contours of predetermined radii and said rocker key positioned between said spacer means so as to directly engage said outer, concave, semi-cylindrical bearing surface contours of said rocker arm and reaction member, respectively, each having a predetermined radius with said rocker key defining a pair of opposed, spaced apart inner, convex, semi-cylindrical bearing surface contours which cooperate with a respective one of said outer cylindrical bearing surfaces to carry the reaction forces of rocker arm pivotal movement, said outer, semi-cylindrical bearing surface contours being about 1.7:1 to 3:1 times the radius of said inner, semi-cylindrical bearing surface contours, whereby within the range of said rocker arm oscillation said rocker key is in substantially rolling contact with the outer, semi-cylindrical bearing surface contours on said rocker arm and on said reaction member and wherein said rocker key rocks during oscillation of said rocker arm.

5. A reciprocating internal combustion engine of the type having an engine block defining a cylinder with a port, a valve reciprocably located in said port and biased to a predetermined position, a valve actuator spaced from the valve and movable in opposite sense to reciprocate said valve, and a valve train means including an inverted U-shaped rocker arm in engagement at opposite ends with the valve and the valve actuator and actuated in rocking movement through a range of rocker arm oscillation to reciprocate said valve against said bias to open and close the port for engine operation, the improvement comprising: means defining a rocking support intermediate the length of said rocker arm, said means including a fixed reaction member, spaced apart spacer means and a rocker key positioned between said spacer means and positioned between and directly engaging said reaction member and said rocker arm; said rocker arm and said reaction member defining a pair of opposed, spaced apart recessed outer, semi-cylindrical bearing surface contours of predetermined radii and said rocker key being operatively positioned to engage said outer, semi-cylindrical bearing surface contours of predetermined radii with said rocker key defining a pair of opposed, spaced apart inner, semi-cylindrical bearing surface contours which cooperate with said outer, semi-cylindrical bearing surfaces to carry the reaction forces of rocker arm pivotal movement, said outer, semi-cylindrical bearing surface contours being about 2 times the radius of said inner, semi-cylindrical bearing surface contours, whereby within the range of rocker arm oscillation said rocker key is in substantially rolling contact with the outer, semi-cylindrical bearing surface contours on said rocker arm and on said reaction member wherein said rocker arm rocks during oscillation of said rocker arm.

6. In a reciprocating internal combustion engine according to claim 5, the improvement wherein at least the valve actuator end of the rocker arm is of an inverted U-shaped configuration as defined by a base with side walls depending from opposite sides of said base wall, a roller follower operatively and rotatably positioned between said side walls, a pin means operatively associated with said side walls and said roller follower so as to capture said roller follower between said side walls, said roller follower having an external diameter such that the outer peripheral surface of said roller follower is in rolling contact with said base wall and the said valve actuator.

7. A rocker arm for use in the valve train of an engine of the type wherein the rocker arm is mounted for pivotal movement as actuated by a valve actuator at one end so as to effect the opening and closing movement of a valve operatively engaged by the opposite end of the rocker arm, said rocker arm having at least one end thereof of inverted U-shaped configuration as defined by a base wall with side walls depending from opposite sides of said base wall; a roller follower operatively and rotatably positioned between said side walls, said roller follower having a cylindrical outer peripheral surface of an external diameter whereby said outer peripheral surface is in rolling contact with said base wall and with at least one of said valve actuator or said valve; and, a roller support pin operatively associated with said roller follower and with said side walls whereby to permit free rolling contact of said outer peripheral surface of said roller follower with said base wall while maintaining retention of said roller follower on said rocker arm between the said side walls thereof.

8. A rocker arm according to claim 7 wherein said side walls are each provided with an elongated slot and wherein said roller support pin is fixed to said roller follower so that opposite ends of said roller support pin extend axially outward of said roller follower so as to be loosely received in said elongated slots.

9. A rocker arm according to claim 7 wherein said roller follower has an enlarged bore extending axially therethrough, said side walls each having a circular aperture therethrough and, wherein said roller support pin extends loosely through said bore of said roller follower with opposite ends of said support pins being fixedly received in said apertures in said side walls.

10. A rocker arm according to claim 8 wherein a shock absorbing bushing is fixed in said bore of said roller follower so as to loosely encircle said roller support pins.

* * * * *